United States Patent [19]

Liljestrand

[11] 3,967,679

[45] July 6, 1976

[54] MUD SAVER VALVE

[75] Inventor: Walter Emanuel Liljestrand, Midland, Tex.

[73] Assignee: Smith International, Inc., Houston, Tex.

[22] Filed: Feb. 21, 1975

[21] Appl. No.: 551,898

[52] U.S. Cl. ..... 166/224 A; 137/71; 137/515.5; 175/218

[51] Int. Cl.[2] ..... E21B 21/00; E21B 41/00

[58] Field of Search ..... 166/224 R, 224 A; 175/218, 65; 137/512.1, 493.1, 536, 512.2, 71, 515.5

[56] References Cited

UNITED STATES PATENTS

| | | | |
|---|---|---|---|
| 3,698,411 | 10/1972 | Garrett | 166/224 R |
| 3,698,426 | 10/1972 | Litchfield et al. | 166/224 R |
| 3,738,436 | 6/1973 | Litchfield et al. | 175/218 |

*Primary Examiner*—James A. Leppink
*Attorney, Agent, or Firm*—Murray Robinson

[57] ABSTRACT

A drilling fluid saver valve connected to the lower end of a kelly allows down flow of mud or other drilling fluid when pumps are actuated to circulate drilling fluid. The valve closes when the pumps are off, thereby to retain drilling fluid thereabove in the kelly. This prevents loss of fluid when the kelly and valve are disconnected from the drill pipe. The valve includes a tubular body and a top sub screwed therein. A replaceable seat is carried by the lower end of the sub. A poppet type valve closure is urged upwardly against the seat by a helical spring strong enough to close the valve against the weight of drilling mud in the kelly. The closure has a tubular stem extending down through the spring. The poppet valve closure has a central flow passage therethrough, communicating with the stem and controlled by an upwardly opening check valve, to communicate drill pipe pressure to the kelly when the pumps are off. The check valve closure is frangible for easy break-out if wire line tools need to be run. The poppet valve stem has ports to allow fluid passing below the closure to enter the stem and flow down therethrough, by-passing an annular chamber between the stem and body in which the spring is disposed. The chamber is sealed by upper and lower seal means between the stem and body and is kept at atmospheric pressure.

15 Claims, 4 Drawing Figures

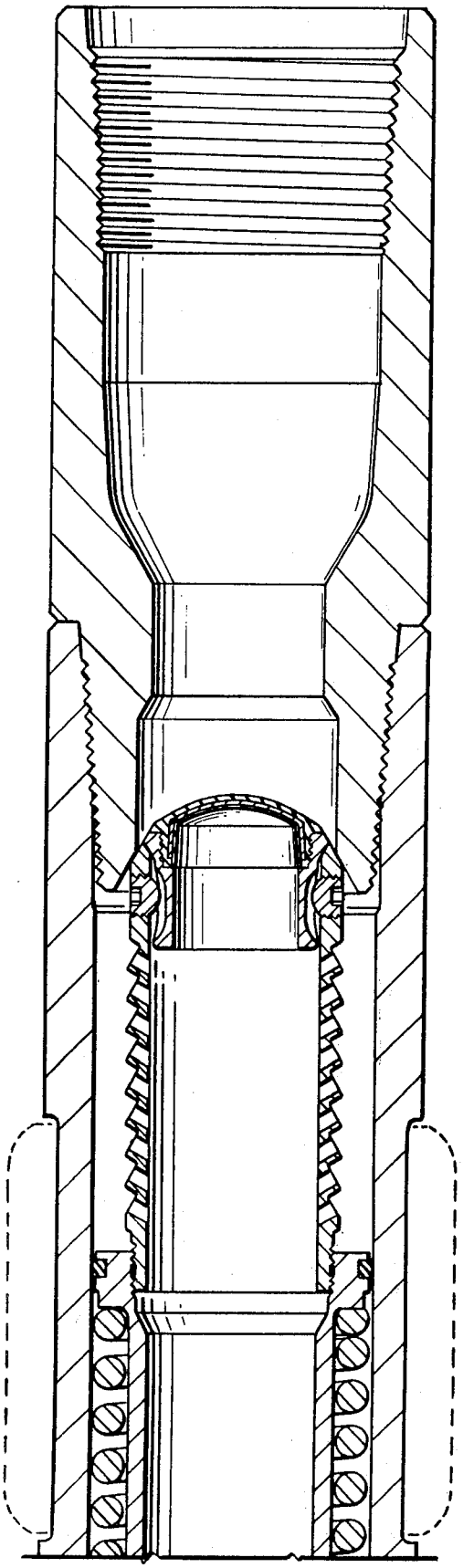
PRIOR ART
Fig. 1A
Fig. 1B
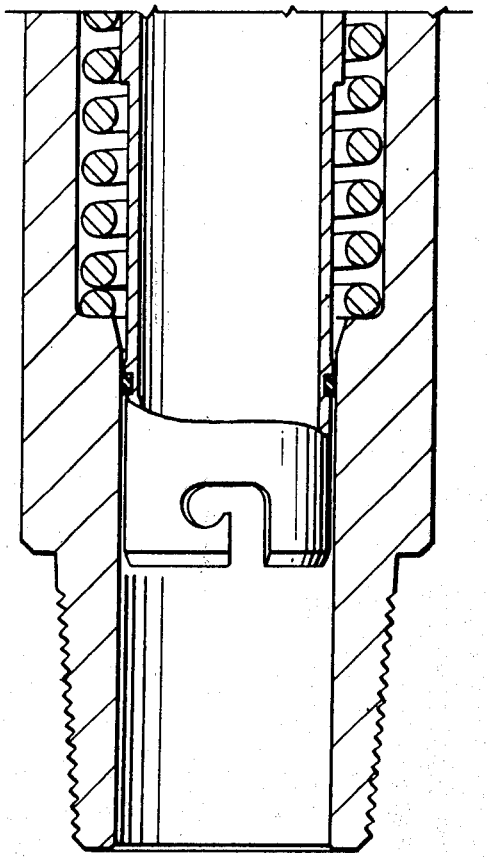

MUD SAVER VALVE

CROSS-REFERENCE TO RELATED APPLICATION.

An improvement upon the construction disclosed in the present application is disclosed in the application of Joseph Stephen Williamson, Ser. No. 551,897, filed concurrently herewith on Feb. 21, 1975, entitled Mud Saver Valve, the disclosure of which is incorporated herein by reference.

BACKGROUND OF THE INVENTION

This invention relates to earth boring by the rotary system of drilling and more particularly to mud saver valves or kelly foot valves, used at the lower end of the kelly to retain the drilling fluid in the kelly when the connection between the valve and drill pipe is broken.

The function and operation of mud saver valves and the development of the art by early workers in this field are discussed in U.S. Pats. No. 3,698,426 and 3,738,436 issued on the applications of Litchfield and Scott and in U.S. Pat. No. 3,698,411 issued on the application of William R. Garrett, the disclosures of these three patents being incorporated herein by reference. The prior art cited in these three patents and the references cited against them during their prosecution may be referred to for further background.

A commercial embodiment of the mud saver valve disclosed in the aforementioned Garrett patent, hereinafter sometimes referred to as the Model A valve, is shown in FIG. 1 of the accompanying drawings. As in the aforementioned Garrett patent the valve includes a top sub whose lower end provides a poppet valve seat, the sub being screwed into a tubular body in which the poppet valve closure moves axially. The latter comprises a ring at the upper end of a tubular stem and a frangible breakout cap with a tubular guide slidable in the stem. The cap and ring form an upwardly opening check valve. The stem has a radial flange moving in a counter bore in the body and is sealed to the body at the flange and below the counter bore to define a sealed chamber at atmospheric pressure. The seals are effected by snap-on unidirectional double lip type plastics material seal rings, namely seals with the trademark Polypak made of polyurethane filled with molybdenum disulfide; there being an O-ring spreader between the two lips. The drawing scale is such that these details are not shown. Within the chamber is a coil spring urging the poppet valve upwardly against the seat on the top sub. Compared to the Garrett patent construction, the breakout cap of the upwardly opening check valve closure in the downwardly opening poppet valve closure is of more gently sloping convexity (viewed from above), since a thicker drilling fluid boundary layer over the cap will streamline the flow. The tubular poppet stem is in two pieces for easy replacement of the upper foraminous crossover portion wherein the fluid moves from the outside to the inside of the tubular stem and is filtered or screened in the process. There is a threaded pin on the lower end of the upper portion to which is screwed a box on the upper end of the lower sealed chamber forming portion of the stem. There is a J-slot in the lower end of the stem for engagement with a pulling tool during assembly. By this means the spring can be compressed enough for the top sub threads to engage with the body. This eliminates the need for a separate threadably connected bottom sub. Therefore the bottom pin connector is made integral with the valve body. A rubber protective sleeve is disposed around the sub that forms the mud saver valve body.

Around 1971 or 1972 several hundred or so Model A valves were made and sold and used. Difficulties experienced with the Model A valve included: (1) frequent manufacturing departures from design at the metal-to-metal juncture of poppet valve seat and closure, resulting in leakage, (2) erosion of this same metal-to-metal juncture during usage, (3) turbulence in the drilling fluid flow-stream due to wings on the screw cap of the check valve, (4) release of the rubber threads on the screw cap, (5) canting of the check valve closure, (6) displacement from intended position on the lower or chamber forming portion of the stem of the snap-on upper and lower plastics material O-ring seals, such displacement occurring when the stem and seal assembly is inserted in the valve body, the seal rings rotating in their grooves or rolling out of their grooves, and (7) loss by the customer of the assembly tool that is used to engage the lower end of the valve stem to draw it down and pre-compress the valve spring sufficiently to allow the top sub to be screwed into the valve body.

In an effort to overcome the foregoing difficulties a construction hereinafter sometimes referred to as the Model X valve was invented, a principal feature of which is the provision of screw-jack means in the valve stem for compressing the valve spring during assembly. A bridge forming one element of the screw-jack means is somewhat similar to a construction that has been suggested for use in a vibration dampener, but which is still in the development stage. Another feature of the Model X valve is that seal ring displacement during assembly is overcome by making it unnecessary to stretch the plastics material seal rings during assembly. It was found that such rings take a substantial time to recover their initial diameter after being stretched to slip over the valve stem and their protusion was the cause of their later displacement when the stem was assembled into the valve body. A further feature of the Model X valve is a replaceable non-metallic seat provided in the top sub to eliminate the metal-to-metal juncture. All of this was the work of the present inventor. The Model X valve also incorporated a new construction for the check valve which was attributable to the inventor who is the applicant in the aforementioned Williamson application filed concurrently herewith. The rubber screw cap threads were replaced by metallic threads on the metal breakout disc, and the check valve guide stem was lengthened. The rubber cover was bonded to the breakout disc and its outer periphery was provided with a skirt overlying the threaded juncture of the breakout disc and the check valve closure ring. The skirt provides also a means to grip the cap during assembly, the rubber wings having been eliminated.

Around June 1972, about five Model X valves were built and put out for test without any remuneration to the manufacturer. It is understood that one of the recipients of these Model X valves received some rental from a user in about December, 1972. The valves ultimately were all received back by the manufacturer. In view of the tests changes were made, the new construction, sometimes hereinafter called the Model B, being for commercial production. It incorporates inventive features of the Model X valve and further inventions of the aforesaid Williamson. The aforementioned Williamson copending application is directed to these further improvements as well as those features of the Model X valve which were the invention of Williamson. The present application claims those features of the Model X valve which are the invention of the present applicant.

SUMMARY OF THE INVENTION

According to the invention the lower or chamber-forming portion of the poppet valve stem is divided into two parts which are screwed together. The upper part is provided with a downwardly facing shoulder and the lower part is provided with an upwardly facing shoulder. An annular bridge straddles the upwardly facing stem shoulder and the upwardly facing shoulder in the valve body and forms the bottom of the sealed spring chamber. The helical spring that is disposed in the sealed chamber and which biases the poppet valve to closed position has its upper end bearing on the downwardly facing stem shoulder and its lower end bearing on the bridge. During assembly the two parts of the lower portion of the stem are screwed together to pre-compress the spring, the bridge bearing on the shoulder on the lower part of the stem. Then the spring, stem, and valve closure are inserted into the valve body with the bridge resting on the body shoulder and the spring is further compressed by screwing the top sub into the valve body. The stem moves down and the shoulder on the lower part of the stem moves away from the bridge which then rests solely on the body shoulder. The pre-compression of the spring by means of the screw jack formed by the two part lower portion of the poppet valve stem is sufficient to allow the top sub threads to engage the valve body threads for the final compression.

Further in accordance with the invention the poppet valve stem is sealed to the valve body by an upper seal means captured between the crossover and chamber forming portions of the valve stem and by a lower seal means which includes the aforementiond bridge. The bridge includes a tail portion extending therebelow having a smaller outer diameter than does sealed chamber, the outer periphery of the tail portion being sealed to the inner periphery of the valve body below the body shoulder at the lower end of the sealed chamber. This construction insures that when the valve opens the spring is compressed by the stem flange and upper seal means moving down rather than by the bridge of the lower seal means moving up off the body shoulder.

Each seal means comprises a back-up ring made of metal somewhat softer than steel, e.g., brass or bronze, and a plurality of non-metallic, e.g., elastomeric, lip-type seal rings. In the case of the lower seal means the bridge is provided on its exterior with a pair of lip type downwardly facing, smaller, snap-on seal rings for a stationary seal between the bridge and valve body. The interior of the bridge is provided with a pair of lip type larger, downwardly facing snap-in seal rings. The upper seal means includes a pair of larger, upwardly facing, lip type seal rings assembled without diameter change, being captured between stem shoulder and back-up ring. All of the seal rings, upper and lower, larger and smaller, are provided with orientation configurations, e.g., bevels, fitting correlative configurations, e.g., bevels, in the receiving grooves formed by the stem, back-up ring, and bridge. These insure proper assembly, i.e., with the seal rings facing in the proper direction.

A further feature of the invention is the replaceable soft seat for the poppet valve. The seat is formed by an elastomer ring having a downwardly facing seat portion and an upwardly extending annular securement pin. The pin is received in a socket on the lower end of the top sub. The pin has an outwardly extending flange received in an annular groove in the socket. A snap ring inside the pin insures its retention in the groove.

The above disclosed features of the invention overcome difficulties experienced with the Model A valve. Other objects and advantages of the invention will become apparent from the following description of a preferred embodiment thereof.

BRIEF DESCRIPTION OF THE DRAWINGS

For a more detailed description of the invention reference will now be made to the accompanying drawings wherein FIGS. 1A and 1B comprise a vertical axial section, showing the prior art Model A mud saver valve.

DESCRIPTION OF PREFERRED EMBODIMENT

BODY

Figure 2A:
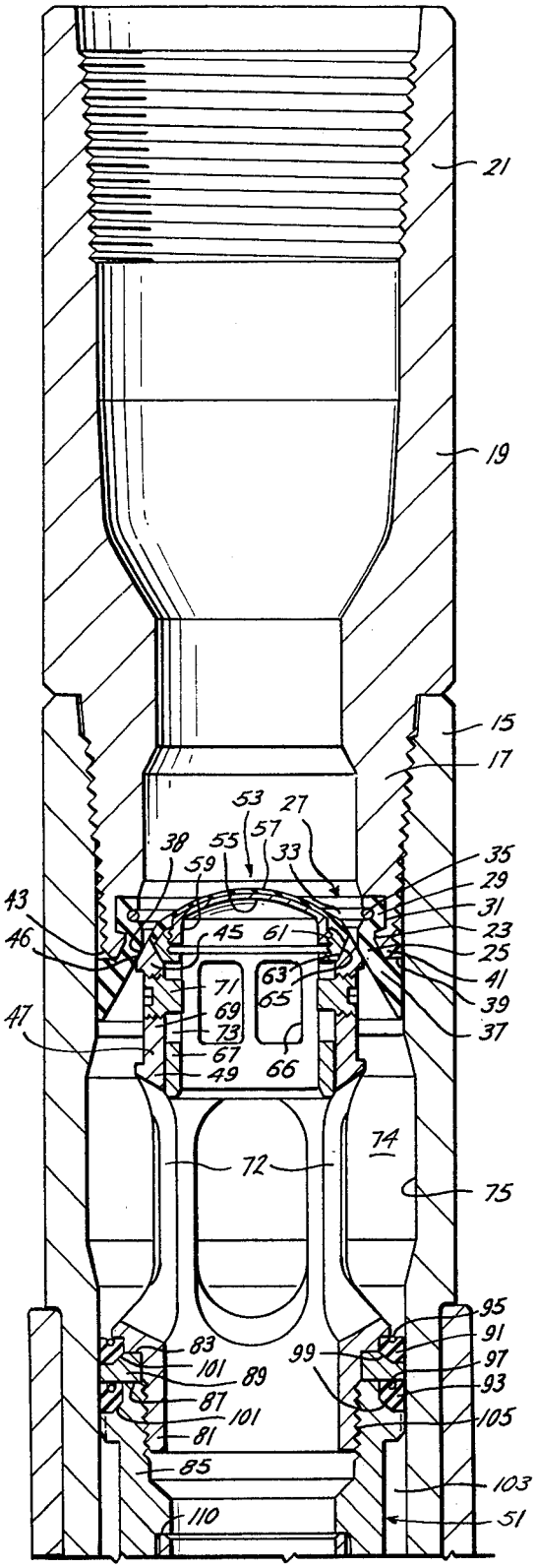
FIGS. 2A and 2B comprise a vertical axial section showing the experimental Model X valve incorporating a preferred embodiment of the invention as of the time the invention was made.
Figure 2B:
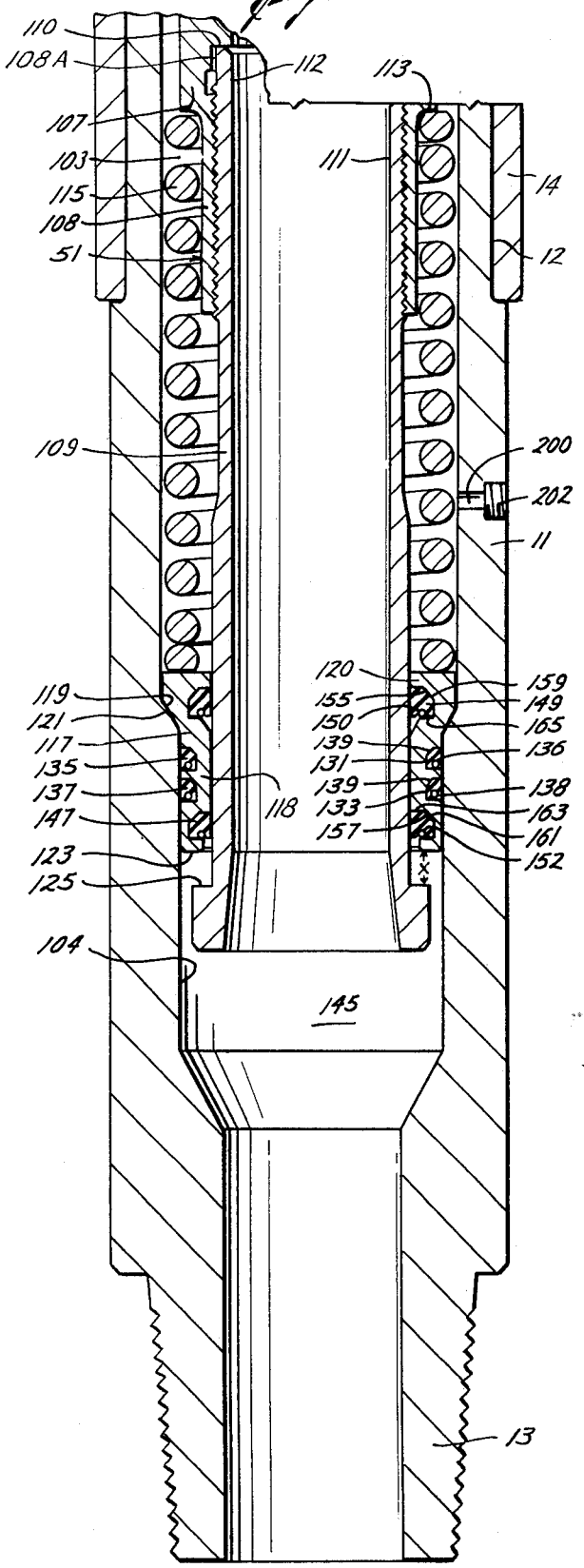

The prior art Model A valve shown in FIG. 1 has already been described hereinabove. Reference will now be made to FIG. 2 which shows the Model X valve. The material of the valve is steel except as otherwise noted. The mud saver valve shown in FIG. 2 includes a tubular body 11 having an annular groove 12 therearound to receive a rubber protector sleeve 14. The body has a tapered threaded pin 13 at its lower end for making a rotary shouldered connection with the upper end of a string of drill pipe. The upper end of the body 11 is provided with a tapered threaded box 15 for making a rotary shouldered connection with threaded pin 17 on top sub 19. A threaded box 21 or other suitable connector means is provided at the upper end of the sub 19 for making a rotary shouldered connection with the lower end of a kelly.

POPPET VALVE SEAT

The lower end of pin 17 is provided with a socket 23 for receiving neck 25 of an elastomeric seat ring 27. The neck 25 has an outwardly extending annular flange 29 received in annular groove 31 in the socket 23. A steel snap ring 33 received in annular groove 35 in neck 25 retains flange 29 in groove 31. The lower end of seat portion 37 of seat ring 27 is tapered, flaring downwardly, providing a conical surface 38 to engage and seal with a correlative conical surface on a poppet valve closure to be hereinafter described. The shoulder 39 formed at the juncture of the seal portion and neck of the seat ring extends under the lower end 41 of the top sub and is partially supported thereby, but the outer periphery of the lower end 41 is bevelled at 43 so that the outer periphery of the seat portion of the seat ring can flex as may be desirable during assembly and use.

POPPET VALVE CLOSURE

The poppet valve closure includes a poppet ring 45 having an upwardly facing, downwardly flaring, conical outer peripheral seal face 46 for engagement and sealing with the correlative surface 38 of the seat ring 27. Extending down from poppet ring 45 is poppet valve stem 47 which is tubular and includes an upper or cross over portion 49 and a lower sealed chamber forming portion 51. The stem will be described in more detail hereinafter.

CAP

The poppet valve closure further includes a cap 53 comprising breakout disc 55 of aluminum or other brittle metal and a plastics material wear cover 57 bonded to the disc. The disc has a downwardly extending peripheral flange 59 which is exteriorly threaded for engagement with cap ring 61. The cover 57 extends beyond disc 55 outwardly over cap ring 61, overlying the threaded connection therebetween.

CHECK VALVE

The outer periphery of cap ring 61 is conical, flaring upwardly, providing a seating surface 63 correlative to the conical, upwardly flaring, seat 65 at the inner periphery of stem ring 45. Together cap 53 and stem ring 45 form an upwardly opening check valve controlling flow through the stem ring; these parts also form the closure for the poppet valve whose seat is provided by seat ring 27.

CHECK VALVE STOP

Cap ring 61 has a downwardly extending tubular guide 67 adapted to slide up and down inside the top or guide part 69 of upper poppet stem portion 49. A stop pin 71 screwed into guide part 69 extends into slot 73 in guide 67 providing means to limit upward travel of the cap relative to the stem ring.

CHECK VALVE CROSS OVER PORTION

The guide stem 67 of the check valve is provided with a plurality of radial ports 66 whereby the pressure of the drilling fluid, i.e., mud, from the drill string can enter the interior of the top sub 19. As the check valve opens due to the pressure below the mud saver valve, the pressure of the mud in the drill string is transmitted up through poppet valve stem 49 into check valve guide stem 67, through the ports 66, and around the check valve cap 53 into the top sub flow passage. The amount of such reverse mud flow will not be great since the mud pumps limit such reverse flow.

POPPET VALVE STEM CROSS OVER PORTION

The cross over portion 49 of the poppet valve stem 47 is provided with a plurality of large radial ports 72 whereby drilling fluid flowing down from the kelly past the poppet valve closure into annulus 74 between stem 47 and body 11 can enter the interior of stem 47. The interior of the body 11 is enlarged at 75 opposite the ported part of stem 47. This reduces the flow velocity and erosion in the area of the ports.

UPPER SEAL

The lower end of cross over portion 49 of the poppet valve stem is provided with a tapered threaded pin 81 and shoulder 83 making a rotary shouldered connection with tapered threaded box 85 on the sealed chamber forming portion 51 of the poppet valve stem 47. Captured between end shoulder 87 of the box and shoulder 83 of the pin is seal backup ring 89, preferably formed of brass, bronze, or other metal softer than steel but having sufficient strength to back up non-metallic, upwardly facing, lip-type seal rings 91, 93, which seal against down flow from annulus 74. Each seal ring 91, 93 is preferably an elastomer such as polyurethane whose upper face is parted by an annular groove to form inner and outer lips, the lips being separated by an O ring as shown at 95, 97. This type of seal ring is well known to the industry as a Polypak. However, an improvement according to the invention is the provision of bevels 99 which match correlative bevels 101 on the box and back-up ring so that the seals cannot inadvertently be assembled upside down.

The top seal ring 91 prevents flow from the annulus 74 downwardly into sealed chamber 103 between the lower portion of the poppet valve stem 51 and the valve body 11. Seal ring 93 prevents flow from inside stem 47 up through threaded connection 105 and thence into sealed chamber 103. Hence, no separate thread seal is required for threaded connection 105, although one may be used if desired.

SCREW JACK

The lower or sealed chamber forming portion 51 of the poppet valve stem 47 includes an upper part 107 provided with a straight threaded box 108, an unthreaded socket 108A, and an internal shoulder 110, forming a rotary shouldered connection with a straight threaded pin 111 and unthreaded, cylindrical tip 112 on the lower part 109 of sealed chamber forming portion 51 of the poppet valve stem. The upper stem part 107 has a downwardly facing annular shoulder 113 forming a bearing for the upper end of helical compression spring 115 disposed concentrically around lower stem portion 51. The lower end of spring 115 bears on top of bridge 117. The bridge has a downwardly facing annular bevelled shoulder 119 which seats on an upwardly facing bevelled shoulder 121 in the valve body 11. The lower end of the bridge has a downwardly facing end shoulder 123 adapted during assembly to engage upwardly facing shoulder 125 at the lower end of lower part 109 of the lower portion 51 of poppet valve stem 47. The lower part 118 of the bridge forms an annular tail depending from the upper part 120 of the bridge. The upper part bridges between the stem and the interior of the spring chamber 103. The tail extends down between the stem and the valve body below the spring chamber 103.

The two piece lower valve stem portion 51 with the straight threaded connection between its parts and the shoulder 113 and bridge 117 thus form a screw jack means for initial compression of the spring. The spring 115 is assembled over the lower stem part 109 on top of bridge 117. Then the upper stem part 107 is screwed onto part 109 to pre-compress the spring about 3 inches. This assembly, together with the upper portion 49 of the poppet valve stem and the check valve at its upper end, is inserted into the valve body with the bridge resting on shoulder 121. The pre-compression of the spring is sufficient so that the tapered threads on the pin 17 of the top sub 19 can engage the tapered threads in the box 15 at the upper end of the valve body 11. When the latter pin and box are made up shoulder tight, the spring 115 is further compressed about ½-inch pushing stem 47 down and leaving distance X between bridge end shoulder 123 and stem shoulder 125, as shown in the drawing. This is about the space required to allow for manufacturing tolerances and still insure that the spring urges the poppet valve closure tightly against its seat.

LOWER STEM SEAL

The outer periphery of the tail of the bridge has two annular grooves 131, 133 within which are received two smaller, double lip seal rings 135, 137 similar to the large seal rings 91, 93. The lips are kept parted by O-rings 136, 138. The seal rings 135, 137 are also provided with orientation means in the form of bevels 139 cooperating with correlative annular bevels in grooves 131, 133. Since the rings are of small cross section, there is not too much problem with their returning to their original size after being stretched to pass over the lower end of the bridge. Furthermore, bridge and seal components can be assembled sufficiently ahead of other valve elements to allow for return to original size. The seal rings 135, 137 are downwardly facing and seal against upflow of drilling fluid from the interior 145 of the valve body into sealed chamber 103. Since they are not sliding seals like seal rings 91, 93 of the upper seal means or like seal rings 147, 149 on the interior of the bridge, they are not subject to as much wear and can be smaller as shown.

Seal rings 147, 149 are downwardly facing double lip seal rings sealing against upflow of drilling fluid from interior 145 of the valve body into sealed chamber 103. Their lips are kept parted by O-rings 150, 152. Seal rings 147, 149 are similar to rings 91, 93 and are provided with orientation means in the form of annular bevels 155, 157 matching correlative bevels 159, 161 in the annular grooves 163, 165 in the inner periphery of annular bridge 117. Seal rings 147, 149 are not stretched to be assembled with bridge 117 but instead are compressed. Therefore there is no problem of having to wait for them to shrink back to original size before assembly with the stem.

The lower seal rings 135, 137 seal against bore 104 which has a smaller diameter than sealed spring chamber 103. When mud is bearing against the upper seal means and the lower seal means both seal means tend to move to compress the spring. The upper seal means is attached to the poppet valve stem. The effected area of the upper seal means and stem exposed to the difference in pressure between the mud and the air in the sealed chamber is greater than such area of the lower seal means and bridge. Therefore the upper seal means and the stem move down and compress the spring until it goes solid, while the lower seal means and bridge remain seated on shoulder 121 of the valve body. The tail 118 of the bridge makes this possible, for it provides an area for sealing between the bridge and bore 104 rather than between the bridge and sealed chamber 103.

SEAL FAILURE CHECK MEANS

A port 200 in the wall of the valve body communicates sealed chamber 103 below stem shoulder 113 with atmosphere so that fluid leaking into chamber 103 will not disable the valve. Screw plug 202 is inserted into port 200 so that drilling fluid from outside the valve body does not enter during operation. Removal of screw plug 202 after the valve has been lifted out of the hole affords a check for seal failure. If drilling fluid is found, some or all of the seal rings in the upper and lower seal means have failed and may then be replaced.

OPERATION

When the mud saver valve is assembled between the kelly and drill pipe, pump pressure of the drilling fluid opens the poppet valve. The larger area exposed to pressure when the poppet is open keeps the valve open without need for throttling. When it is desired to add a stand of drill pipe, the pumps are shut down. The check valve opens if there is any pressure in the drill pipe above shut down pressure in the kelly, which warns the operator of such pressure. When the valve at the lower end of the kelly is broken away from the drill pipe, the check valve closes under the weight of drilling fluid in the kelly and the poppet closes under action of the spring, which is strong enough to keep the poppet shut under the weight of drilling fluid in the kelly. There is therefore no loss of drilling mud or other drilling fluid from the kelly. If it is necessary to lower a wire line tool through the valve, the cap can be broken through with a bar lowered on a wire line through the kelly. The foregoing is the same with the model A valve.

If the poppet valve seat wears out in use, it may be easily replaced. Since the spring is pre-compressed, the relative rotation of top sub and seal with respect to the poppet valve closure is so minimal that the soft replaceable seat is not damaged. The sealed chamber seals on the poppet valve stem are also easily replaced. If the lower portion of the stem is disassembled, e.g., for replacement of the inner seals on the bridge, the valve is easily reassembled with the screw jack means.

While a once preferred embodiment of the invention has been shown and described, modifications thereof can be made by one skilled in the art without departing from the spirit of the invention. For example as a result of the tests with the experimental Model X valve disclosed herein, further improvements were made as set forth in the aforementioned companion application of J. S. Williamson, but the construction shown in the latter application also embodies the inventive features herein claimed. In this regard it may be noted that since the poppet valve stem of the present invention is divided into upper and lower portions between which is clamped the upper seal means, and the lower portion of the stem is further divided into upper and lower parts to provide a screw jack, the present construction may be characterized as having a three piece stem. In the construction described in the Willamson application the stem is divided into but two pieces, as required to provide a screw jack, the upper seal means being constructed in a different manner from that shown herein. The Williamson construction can be characterized as employing a two piece stem. The three piece stem of the present invention will sometimes hereinafter be referred to as having upper, median and lower sections.

I claim:

1. Mud saver valve adapted for connection between a kelly and a string of drill pipe comprising a tubular valve body having means at its lower end for making connection to a string of drill pipe and tapered threaded and shouldered means at its upper end for making a rotary shouldered connection to a top sub, a tubular top sub having means at its upper end for making connection to a kelly and tapered threaded and shouldered means at its lower end for making a rotary shouldered connection to said tapered threaded and shouldered means on the valve body, said top sub having a downwardly facing valve seat forming part of a poppet valve, closure means for said poppet valve including a seating portion adapted to engage and seal with the poppet valve seat, said closure means including a stem extending downwardly from said seating portion, said stem including an upper part and a lower part, screw thread means connecting said upper and lower parts of the stem, said stem having a downwardly facing shoulder on the upper part thereof and an upwardly facing shoulder on the lower part thereof, an annular chamber between the stem and body, said chamber having an upwardly facing shoulder, bridge means around said stem overlying said chamber shoulder and said upwardly facing stem shoulder, and spring means disposed around said stem in said chamber and under compression, bearing at its lower end against said bridge and at its upper end against the downwardly facing shoulder on the stem, said bridge being separated from the upwardly facing stem shoulder when the valve is in use but engageable with said shoulder when the top sub is unscrewed.

2. Valve according to claim 1 wherein the screw thread means connecting the upper and lower parts of the stem is a straight-threaded rotary shouldered connection forming a seal between said stem parts.

3. Valve according to claim 1 including upper and lower seal means between the tubular valve body and said stem to seal said chamber from other interior portions of the valve, said lower seal means comprising stationary seal means between said bridge and the valve body and slidable seal means between said bridge and said stem.

4. Valve according to claim 1 including upper and lower seal means between the tubular valve body and said stem to seal said chamber from other interior portions of the valve, said upper seal means comprising seal ring means captured between oppositely facing shoulders on said stem, said stem being partable between the last said shoulders for assembly of said seal ring means.

5. Valve according to claim 1 including upper and lower seal means between the tubular valve body and said stem to seal said chamber from other interior portions of the valve, at least one of said seal means including unidirectional means sealing preferentially in one direction, and orientation means on the unidirectional sealng means to insure proper assembly thereof.

6. Valve according to claim 1 wherein the valve seat is formed of sealing material softer than steel.

7. Valve according to claim 1 wherein the valve seat is separable from the top sub.

8. Valve according to claim 1 wherein the valve seat is formed by an elastomer tube inserted into the lower end of the top sub and including releasable means for retaining the tube in the sub.

9. Mud saver valve adapted for connection between a kelly and a string of drill pipe comprising a tubular valve body having means at its lower end for making connection to a string of drill pipe and tapered threaded and shouldered means at its upper end for making a rotary shouldered connection to a top sub, a tubular top sub having means at its upper end for making connection to a kelly and tapered threaded and shouldered means at its lower end for making a rotary shouldered connection to said tapered threaded and shouldered means on the valve body, said top sub having a downwardly facing valve seat forming part of a poppet valve, closure means for said poppet valve including a seating portion adapted to engage and seal with the poppet valve seat, said closure means including a stem extending downwardly from said seating portion, said stem including an upper section, a median section, and a lower section, screw thread means connecting said upper and median section and said median and lower sections of the stem, said stem having downwardly facing shoulders on said upper and median sections thereof and upwardly facing shoulders on said median and lower sections thereof, an annular chamber between the stem and body, the chamber forming portion of said valve body including an upper portion and a lower portion having a smaller diameter than said upper portion, said diameter change occuring below said downwardly facing median stem section shoulder, flange means on said stem sealing against said upper portion of said chamber forming portion of the valve body and being captured between said downwardly facing upper stem section shoulder and said upwardly facing median stem section shoulder, fluid passage means through the side of said valve stem above said flange means, lower seal means on said stem sealing against said lower portion of said chamber forming portion of the valve body, said lower seal means including bridge means around said stem overlying said valve body diameter change portion and said upwardly facing lower stem section shoulder, a sealed annular chamber formed between said flange means and said lower seal means and between the valve stem and valve body, spring means disposed around said stem in said sealed chamber and under compression, said spring means bearing at its upper end against said downwardly facing median stem portion shoulder and at its lower end against said bridge means, said bridge means being separated from the upwardly facing lower stem portion shoulder when the valve is in use but engageable with said shoulder when the top sub is unscrewed, and said flange means and said lower seal means being exposed to drilling mud pressure such that due to the difference in diameter of the flange means and lower seal means a net downward force is exerted on said valve stem.

10. Valve according to claim 9 wherein said downwardly facing valve seat is replaceable and separable from the top sub.

11. Valve according to claim 9 wherein the valve seat is comprised of a tubular body of a material softer than steel which body is inserted into the lower end of the top sub and retained in the sub by releasable means.

12. Valve according to claim 9 wherein the screw thread means connecting the upper and median stem parts is a tapered-threaded connection and the screw thread means connecting the median and lower stem parts is a straight-threaded rotary shouldered connection forming a seal between said stem parts.

13. Valve according to claim 9 wherein said lower seal means comprises stationary means between said bridge and the valve body and slidable seal means between said bridge and said stem.

14. Valve according to claim 9 wherein said flange means comprises seal ring means.

15. Valve according to claim 9 wherein said flange means and said lower seal means include unidirectional means sealing preferentially in one direction, and orientation means on the unidirectional sealing means to insure proper assembly thereof.

* * * * *

UNITED STATES PATENT OFFICE

CERTIFICATE OF CORRECTION

Patent No. 3,967,679 Dated July 6, 1976

Inventor(s) Walter E. Liljestrand

It is certified that error appears in the above-identified patent and that said Letters Patent are hereby corrected as shown below:

Column 9, line 43, "sealng" should read -- sealing --.

Column 2, line 38, "protusion" should read -- protrusion --.

Signed and Sealed this

Twenty-first Day of September 1976

[SEAL]

*Attest:*

RUTH C. MASON
*Attesting Officer*

C. MARSHALL DANN
*Commissioner of Patents and Trademarks*